United States Patent [19]

Braithwaite

[11] 4,240,613

[45] Dec. 23, 1980

[54] WINCH MECHANISM

[75] Inventor: John C. Braithwaite, Broughton-in-Furness, England

[73] Assignee: Vickers Shipbuilding Group Ltd., Barrow-In Furness a, England

[21] Appl. No.: 26,681

[22] Filed: Apr. 3, 1979

[30] Foreign Application Priority Data

Apr. 4, 1978 [GB] United Kingdom ..... 13204/78

[51] Int. Cl.[3] ..... B66D 1/48

[52] U.S. Cl. ..... 254/315; 254/264; 254/361

[58] Field of Search ..... 254/170, 172, 175.5, 254/150 R, 150 FH, 158, 160; 414/706; 60/443–445

[56] References Cited

U.S. PATENT DOCUMENTS

| | | | |
|---|---|---|---|
| 3,817,033 | 6/1974 | Appel et al. | 60/444 |
| 4,025,055 | 5/1977 | Strolenberg | 254/172 |

*Primary Examiner*—Leonard D. Christian

*Attorney, Agent, or Firm*—Browdy and Neimark

[57] ABSTRACT

A winch mechanism of the deep lift type comprises a variable displacement hydraulic pump/motor which is adjusted so as to support from a ship or the like via a rope haulage mechanism a submerged load under the influence of pressurized hydraulic fluid which is stored at a substantially constant pressure in a high pressure accumulator and in a low pressure accumulator. As the ship rises and falls, forces on the submerged load are sufficient to maintain the load substantially stationary with hydraulic fluid being passed via the pump/motor between the two accumulators. Lifting is accomplished by a pump which circulates hydraulic fluid through the pump/motor.

13 Claims, 6 Drawing Figures

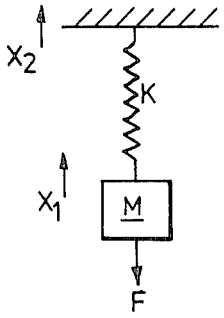
-FIG.1-
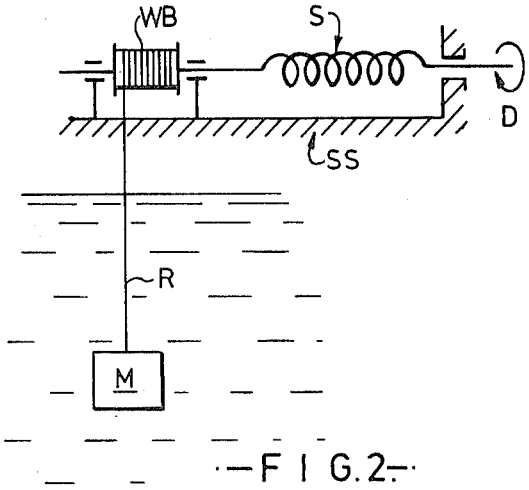
-FIG.2-
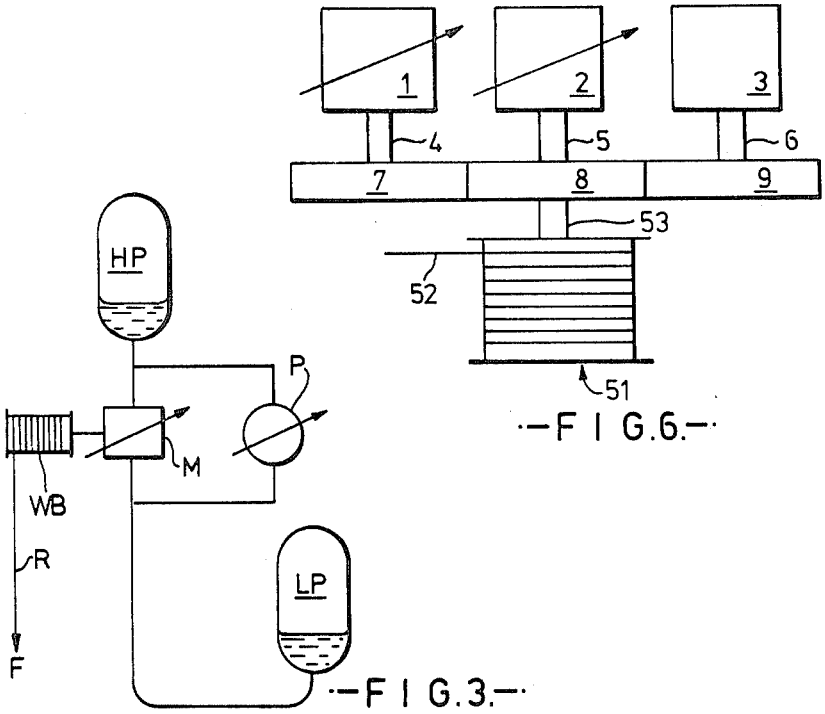
-FIG.6-
-FIG.3-

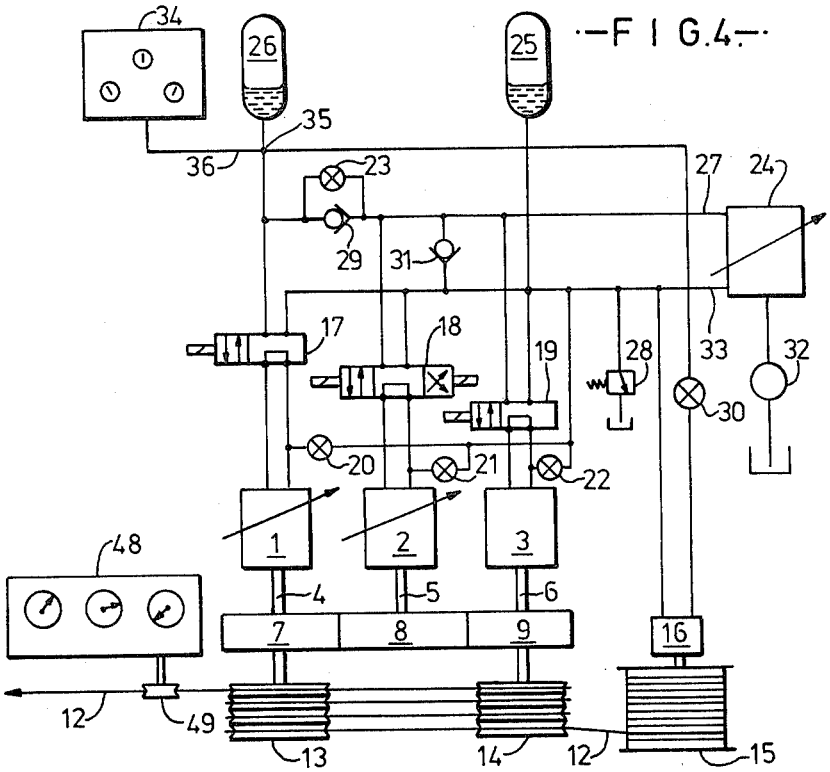
·—F I G.4.—·
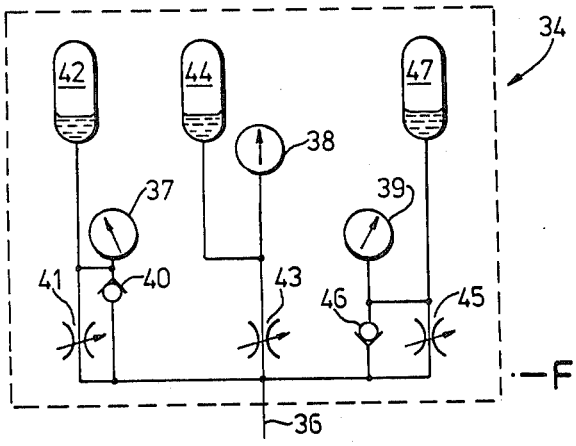
·—F I G.5.—·

WINCH MECHANISM

FIELD OF THE INVENTION

This invention relates to winch mechanisms and, more particularly but not exclusively, is concerned with such mechanisms for use in the recovery of non-buoyant objects such as sunken submersibles, anchors and diving bells, and that are also suitable for use in towing at sea, or mooring.

When recovering a non-buoyant object from the sea bed, by means of a rope hauled by a common winch mounted upon the deck of a heaving and pitching ship, whatever the degree of resilience of the rope, it is virtually impossible to avoid incurring resonance or rope snatch at some stage during the lift, imparting violent motion to the object. This can severely overload the rope, or its attachment to the object being raised.

In deep water of say 2000 ft. or more, even in a very rough sea, there can be sufficient resilience in the rope to limit the motion of the land to a safe amplitude. Under these conditions, the load is effectively suspended from a spring, the top end of which is anchored to the heaving and pitching ship. However, as the load rises and the rope shortens, eventually resonant conditions are reached and motion of the load can become very violent at depths of less than about 600 to 800 ft. Under these conditions, the vertical downward velocity of the ship can exceed the free sinking velocity of the load, resulting in periodic slackening and snatch as the ship motion reverses. Thus, in order to be able to operate a recovery mechanism in very rough seas, the behaviour of the mechanism should be made independent of the elasticity or resilience of the rope used. This can be done by utilising a winch design such that the winch itself acts as a spring of appropriate stiffness, the object being raised tending to behave as a seismic mass, remaining virtually stationary in space with its motion severely limited as compared with that of the ship itself. Only the steady component of rotary motion is transmitted to the non-buoyant object as a steady lifting effect. This is superimposed upon the oscillatory component of rorary motion of the winch.

DESCRIPTION OF THE PRIOR ART

A known way of doing this is to use a hydraulic pump and variable pressure constant displacement motor driven winch with a gas-hydraulic accumulator branching from the high pressure hydraulic fluid supply from the pump to the motor. It is possible so to adjust the quantity of gas within the accumulator that sufficient hydrualic fluid is stored in the accumulator at any given time to allow the ship motion to be superimposed upon a steady lifting motion, the winch alternately paying out and taking in rope, but always taking in slightly more than it pays out at each cycle, according to the delivery setting of the pump. If the negative buoyancy of the object to be raised is known in advance, it is simple to make the appropriate adjustment to the gas pressure when there is no fluid in the accumulator and before starting to lift, to ensure that there will always be sufficient fluid volume to satisfy the transient demands of the winch drive motor, according to the range of motion of the ship.

A major disadvantage of the above-discussed known mechanisms is that if the negative buoyancy of the object to be raised is not known with any accuracy, and this almost invariably is the case in practical situations, establishing the necessary gas pressure to secure the most efficient cushioning of ship motion becomes a hazardous operation, especially when working at moderate depths where the resilience of the rope itself may be inadequate to inhibit snatch during this operation. In such cases, a compromise low pressure charge may have to be accepted. It will also be appreciated that variable pressure constant displacement drive motors involve very large instantaneous fluid flow when compensating for ship motion and are extremely uneconomical in their accumulator capacity requirements.

Continuing the lift through the sea-air interface to bring the object out of the water poses no difficulty, though there is considerable delay while hydraulic fluid is pumped into the accumulator, to compress the gas charge to a pressure which balances the new operating conditions of handling the full weight of the object without the aid of buoyancy forces.

OBJECT OF THE INVENTION

It is an object of the present invention to provide a winch mechanism of relatively simple construction which overcomes the disadvantages of the prior art mechanisms.

SUMMARY OF THE INVENTION

According to the present invention there is provided a winch mechanism comprising a variable displacement hydraulic pump/motor coupled to drive a rope haulage mechanism, a pump connected for pumping operating fluid to the hydraulic pump/motor to impose a steady driving force thereon, a fluid accumulator in the high pressure fluid supply path from the pump to the hydraulic pump/motor, and a reservoir in the low pressure fluid supply path from the hydraulic pump/motor to the pump.

The mechanism may include at least one further pair of hydraulic pump/motors, the or each pair comprising one fixed displacement pump/motor and one variable displacement pump/motor, the pump/motors being drivingly interconnected. The hydrualic pump/motors may be selectively energised for balancing the load to be handled.

Preferably, the reservoir is pressurised to form a low pressure accumulator. The mechanism may include a plurality of high pressure accumulators and a plurality of low pressure accumulators, the accumulators being selectively connectible to tune the mechanism to the prevailing conditions.

In one embodiment, the rope haulage mechanism comprises one or more pulleys drivingly connected to the or at least two of the hydraulic pump/motors, and a rope extending about the or each pulley and to a storage drum for the rope driven by a further hydraulic motor.

In another embodiment, the rope haulage mechanism comprises a winch drum drivingly connected to the or one of the hydraulic pump/motors.

In a further embodiment, the rope haulage mechanism comprises one or more pulleys drivingly connected to the or at least two of the hydraulic pump/motors, a rope extending about the or each pulley and to a locker disposed at a level below the pulley(s).

The winch mechanism may include a selectively engageable non-return valve between the or at least one of the hydraulic pump/motors and the high pressure accumulator to prevent the pump/motor(s) functioning in the pumping mode.

BRIEF DESCRIPTION OF THE DRAWINGS

For a better understanding of the invention and to show how it may be carried into effect, reference will now be made, by way of example, to the accompanying drawings, in which:-

FIG. 1 is a sketch indicating motions and forces arising in lifting a non-buoyant object;

FIG. 2 is a diagram illustrating the basic concept of a winch mechanism;

FIG. 3 is a diagram illustrating basic components of a practical form of winch mechanism;

FIG. 4 diagrammatically illustrates a further form of winch mechanism;

FIG. 5 similarly illustrates a detail of the mechanism of FIG. 1; and

FIG. 6 diagrammatically illustrates a detail in a modified form.

DESCRIPTION OF PREFERRED EMBODIMENTS

The purpose of the present winch mechanism is to provide a resilient suspension for a non-buoyant object which must be recovered in rough seas, such that the minimum of ship motion is communicated to the object and, in effect, only a steady lift motion reaches the object.

The necessary system can be represented by a simple spring mass model as indicated in FIG. 1. Referring to FIG. 1, where K=spring stiffness M=mass of object to be recovered F=negative buoyancy $\omega=\sqrt{(K/M)}$=circular natural frequency of spring mass system $x_1$=displacement of object a=amplitude of ship motion =half total vertical excursion of ship in a seaway $\omega_o$=circular frequency of ship motion impressed upon system $x_2$=displacement of ship from mean position $=a \sin \omega_o t$ t=time Putting $\omega_o/\omega=r$, it can be shown that $$|x_2 - x_1| = a\left|\frac{r^2}{1-r^2}\right|$$

where | |signifies "the absolute value of".

$\Delta F$=variation in spring tension due to relative motion between ship and object being recovered $=|x_2-z_1|K$ The necessary condition that a rope suspending the object shall not go slack is that the force in the spring shall always be tensile, i.e.

$$\Delta F << F.$$

The other important quantity is the absolute motion x, in space.

Thus $$|x_1| = \frac{a}{|1-r^2|}$$

Whilst an elastic rope can provide the necessary resilience at great depths, as the object nears the surface, the stiffness increases with shortening of the rope to a point at which resonance will occur and other means must be provided to avoid this potentially dangerous condition. Thus, since changing length of the rope means that it cannot provide an adequate spring during the whole of the lifting operation, other means must be found to make the system dynamics acceptable whatever the rope length, a means which will avoid the danger of resonance, or of violent impressed motion as the object nears the surface.

A solution is to provide a winch incorporating a torsional spring in the drive for the winch handling the rope, as illustrated in FIG. 2 where:

M=object mass to be recovered

R=rope

WB=winch barrel

S=spring

D=steady state drive

SS=ship's structure

A way to provide the necessary resilience is to use an hydrualic winch with a gas hydraulic accumulator in the high pressure hydraulic fluid supply line. The hydraulic motor-accumulator combination then becomes the spring of FIG. 2, and the pump supplying the system is the steady state drive of FIG. 2. Furthermore, if a variable displacement motor is used such that the winch effort can be made to match the load at a predetermined pressure, then not only can it be ensured that there is always sufficient liquid in the accumulator by adopting a sufficient margin between the initial gas charge pressure and the chosen mean working pressure, but the advantage of using the highest possible gas charge pressure minimises the accumulator volume required to achieve the necessary degree of resilience in the system.

Since the motor must also run as a pump when driven by the rope, it is expedient to pressurise the system and operate from a base pressure sufficient to inhibit cavitation in the low pressure supply line under pumping conditions. To this end a low pressure accumulator is also provided giving the arrangement shown in FIG. 3 in which R is the rope, WB is the winch barrel, M is the motor, P is the pump, HP is the high pressure accumulator and LP is the low pressure accumulator. In this system the following applies:

For the motor M:

V=displacement/unit rope movement $\eta_1$=efficiency when operating as a motor (winch hauling)

$\eta_2$=efficiency when operating as a pump (winch rendering).

For the high pressure accumulator HP $p_c$=mean operating pressure $\Delta p_c$=change in pressure due to gas volume change V (i.e. due to unit rope movement)

$V_c$=gas charge volume in this accumulator at pressure $p_c$ $p_i$=initial gas charge pressure $V_i$=gross accumulator volume (empty of liquid)

$\gamma$=ratio of specific heats of gas charge.

For the low pressure accumulator LP $p_o$=mean operating pressure $V_o$=gas charge volume in this accumulator at pressure $p_o$.

In the system as a whole

F=non-bouyant force applied to winch corresponding to pressure $p_o$

K=stiffness of winch referred to rope

Suffix 1 - monitoring
Suffix 2 - pumping
$C=p_c/p_o$
$dp_c$ is the differential coefficient of $p_c$.

Similarly $dp_o$, $dV_c$ are also differential coefficients. For the accumulators under adiabatic operating conditions, $$dp_c = \frac{-\gamma P_c\, dV_c}{V_c} \text{ and } dp_o = \frac{-\gamma p_o\, dV_o}{V_o}$$

As a motor, when hauling, $F_1=\eta_1 V(p_c-p_o)$
Differentiating, $dF_1=\eta_1 V(dp_c-dp_o)$
When $dp_c=\Delta p_c$ and $dp_o=\Delta p_o$, $dF_1=K_1$
Thus, $$K_1 = \frac{F_1^2\gamma}{\eta_1(p_c-p_o)^2}\cdot\left(\frac{p_c}{V_c}-\frac{p_o}{V_o}\right)$$

In practice, $V_o \simeq V_c$. Then $$K_1 = \left(\frac{C}{C-1}\right)\cdot\frac{\gamma F_1^2}{\eta_1 p_i V_i}$$

Since $P_iV_i=p_cV_c$
Similarly $$K_2 = \left(\frac{C}{C-1}\right)\frac{\eta_2\gamma F_2^2}{p_iV_i}$$

since, when pump, $$F_2 = \frac{V(p_c-p_o)}{\eta_2}$$

A practial value for C is about 10 and $\eta \geqq 0.095$. Because C is common to both $K_1$ and $K_2$, it has no influence on their relative values. However the occurrence of $\eta$ in the numerator when rendering and in the denominator when hauling means that $$(K_1/K_2) = \frac{1}{\eta_1\eta_2}$$

For
$1 > \eta > 0.95$,
$1 < (K_1/K_2 < 1.12$

In other words, there can be up to 12% discrepancy between the two stiffnesses. Providing that $K_2$ is such that the natural frequency of the system based upon this stiffness is very much less than the exciting frequency, the system will behave in a satisfactory manner.

Turning next to FIGS. 4, 5 and 6, in the winch mechanisms of these Figures two variable displacement hydraulic motor 3 dirve multiple grooved pulleys 13 and 14 via shafts 4, 5 and 6, intermeshing gears 7, 8 and 9, and shafts 10 and 11. A rope 12, whose free end is attached to the object being handled, traverses the pulleys 13 and 14, making a number of turns around each, and then passing to a storage drum 15 driven by an hydraulic motor 16. Alternatively, and as illustrated in FIG. 6, the pulleys 13 and 14 and the storage drum 15 with its driven motor 16 can be omitted, and replaced by a winch barrel 51 with a rope 52 (replacing the rope 12) wound thereon. This barrel 51 is directly driven from one of the gears 7, 8 or 9 via a shaft 53.

Valves 17, 18 and 19 control the motors 1, 2 and 3, and a valve 30 controls the motor 16. Futher valves 20, 21 and 22 are disposed to connect the motors 1, 2 and 3 to pressurisation equipment when the valves 17, 18 and 19 are in the "off" position permitting free wheeling of unenergised motors under full lubrication conditions and preventing separation of elements inside the motors which may depend upon pressure to retain contact. It will be understood that as an alternative the valves 20, 21 and 22 may be incorporated in the valves 17, 18 and 19 by the provision of extra ports in the valve spools. The various valves may be, for example, of the piston type, preferably pilot operated and may be manually operated, or pneumatically, electrically or hydraulically operated automatically either from visual (manual operation), or pressure sensor (automatic operation), signals obtained from a pressure gauge unit 34, the aim being to maintain a mean operating pressure as indicated by a gauge 38, which ensures adequate fluid content of a high pressure accumulator 26.

The pressurisation equipment includes a conventional pump unit 24, which may be of fixed or variable delivery type as desired. Pump supply of fluid is via a high pressure line 27. The high pressure gas-hydraulic accumulator 26 is connected to supply fluid to the motors 1, 2 and 3 when demand due to the downward motion of the ship exceeds the delivery rate of the pump unit 24, supply being direct to the motor 1 and a valve 23 being opened when it is required to permit fluid to flow from the accumulator 26 to all energised motors 1, 2, 3. Fluid returns to the pump unit 24 via a low pressure line 33. A low pressure accumulator 25 stores excess fluid flowing via the motors 1, 2, 3 to accommodate a variable volume of fluid in what would otherwise be a constant volume system. A relief valve 28 limits the maximum pressure in the low pressure side of the circuit. The system is pressurised by means of a boost pump 32.

The storage drum drive motor 16 is continuously energised direct from the accumulator 26 via the valve 30 which is left open for the whole of the period during which the winch mechanism is operating. This is to avoid the possible isolation of the motor 16 from a high pressure supply should the valve 23 be closed and the portion of the hydraulic circuit between a non-return valve 29 and the pump unit 24 be at a low pressure by virtue of inadequate hydraulic fluid supply as compared with motor demand. Advantageously the motor 16 is also of the variable displacement type so that the torque applied to the rope 12 can be varied in the sense to maintain approximately constant tension in the rope 12 as the effective diameter of the drum 15 changes with change in the stored quantity of rope. Pump displacement control can be made automatic by sensing the quantity of rope stored, and transmitting an appropriate signal to pump displacement control equipment.

Valves 23 and 29 are incorporated to accommodate the completely different requirements for seismic behaviour while the object is submerged, and the nonoscillatory wave compensating behaviour required when the object is passing through the air-sea interface to become suspended in air. to accomplish this change from the seismic mode, the isolating valve 23 is closed, limiting solely to the motor 1 unconditional access to a high pressure fluid supply, which, by itself, would be unable to sustain the whole weight of the object in air, but exerts sufficient torque to maintain some tension in the rope 12, thereby preventing snatch from occurring. The motor 1 may overdrive the other motors 2 and 3 when they are energised, fluid requirements for motors 2 and 3 in excess of that supplied by the pump unit 24 being provided by recirculation around a closed loop through a non-return valve 31. It will be appreciated that non-return valves similar to the valve 31 may be associated with each relevant motor in order to cut down the pipe sizes required, and also to reduce pipe friction and pressure loss leading to increased resistance to rotation by the motors 2 and 3 when driven as pumps by the motor 1.

Lowering of an unloaded rope is accomplished by reversing the supply of hydraulic fluid to the motor 2 by reversing valve 18, and with valve 23 closed to prevent unloading of the accumulator 26, the other motors being allowed to idle with by-passes open—i.e. the valves 17 and 19 are in the "off" position. Lowering under load is accomplished by energising as many motors as are required to take the load and by reversing the output of the pump unit 24.

To monitor the behaviour of the high pressure hydraulic accumulator 26, the pressure gauge unit 34 is connected via a line 36 to the high pressure accumulator 26 at junction 35, or other suitable point permanently connected to this accumulator when the system is energised.

To measure the approximate lift distance achieved at any given instant, an indicator 48 driven via a shaft 50 from a pulley 49 bearing against the rope 12 contains in its simplest form a gear train with a ten to one ratio between each gear spindle, the spindles carrying pointers indicating either tens, hundreds, or thousands of feet on their associated dials. A worm and wheel drive would form the simplest transmission from the shaft 50 to the rest of the gear train. It will be appreciated that any form of remote transmission, either flexible drive, hydraulic or electrical may replace the shaft 50, and other forms of counter may be employed.

Referring now to FIG. 5, the unit 34 houses three pressure gauges, a pressure gauge 37 reading the minimum pressure obtaining in the high pressure accumulator 26, the pressure gauge 38 reading the mean pressure, and a pressure gauge 39 reading the maximum pressure. Associated with the gauge 37 are a non-return valve 40, a throttle valve 41 and a small gas-hydraulic accumulator 42. Excess pressure acquired via the valve 41 during a cycle of ship motion leaks away through the non-return valve 40, thereby causing the pressure gauge 37 to read exactly the minimum pressure at the instant at which this minimum occurs and a value a little higher than the minimum at other times, the actual error depending upon the size of the accumulator 42 relative to the setting of the throttle valve 41.

The pressure gauge 38 indicating the mean pressure is supplied with hydraulic fluid via a throttle valve 43 in conjunction with a further small gas-hydraulic accumulator 44 to absorb or supply the small flow of fluid through the valve 43, thereby causing the gauge 38 to read the approximate mean pressure in the high pressure accumulator 26.

The third pressure gauge 39 has associated with it a non-return valve 46, a throttle valve 45 and a third small gas-hydraulic accumulator 47. The accumulator 47 receives a full charge of hydraulic fluid via the non-return valve 46 every time the pressure in the high pressure hydraulic accumulator 26 reaches a peak value. Some of this charge will leak away during the cycle via the throttle valve 45 and the gauge 39 will read peak pressure or a little below, the variation again depending upon the size of the accumulator 47 relative to the setting of the throttle valve 45.

The combination of accumulator and throttle valve associated with the pressure gauge 38 constitutes a pressure smoothing device. The combinations of accumulator, throttle valve and non-return valve associated with gauges 37 and 39 constitute minimun and peak pressure sampling devices with throttle valves to permit some leakage so that readings may be updated at the appropriate point in each cycle.

In use with the equipment described above with reference to FIGS. 4 to 6 mounted on a ship and the rope 12 attached to a non-buoyant object submersed beneath the water, wave induced motion of the ship (or other platform upon which the winch and its drive mechanisms are mounted), is superimposed upon a steady lift motion effected by the winch by supplying the transient hydraulic fluid demand from the precharged gas hydraulic accumulator 26 as the ship falls relative to the load. This accumulator 26, sized to contain an adequate quantity of fluid at the chosen mean pressure, is connected into the high pressure supply line, with the further low pressure hydraulic accumulator 25 connected into the return line to store transient flow, until it is returned to the high pressure side by the motors 1, 2 and 3 acting as rope driven pumps as the ship rises again. Transient vertical motion is accommodated by an essentially conservative system, power demand being that for the steady lift alone.

Thus the resilience of the rope is augmented at depth, and progressively replaced by the motor accumulator combination as the load approaches the surface. For a fixed high pressure accumulator gas volume and initial charge pressure, the spring constant is dependent upon the effective displacement of the winch motors necessary to balance the load. In raising a non-buoyant object in water, the effective mass is augmented by entrained water. The necessary disparity between the period of oscillation of the load and the period of excitation due to wave motion is greatest when the load is submerged, and in this way the net oscillatory motion of the object is reduced to a tolerable level to keep the variation of force in the rope to safe limits. Furthermore, the rope can never go slack and be subject to snatch forces, a factor which permits the use of the lightest and most easily handled rope.

The rope driven indicator 48 shows the approximate length of rope paid out or hauled in. It also indicates the approximate range of the vertical component of ship motion.

When the object reaches the surface, it will be held there as if buoyant, unless the effective displacement of the winch motors is increased sufficiently to lift it clear of the sea surface. Two options are then open - either to carry on with the lift, assuming that a suitably heavy rope has been spliced onto the small diameter deep lift-rope in order to cope with the weight of the object in air - or to transfer the lift to other specialised equipment specifically designed for raising floating bodies from the water, the object being held at the surface until the second lift rope has been secured.

If the equipment described is to be used to make the transition through the sea-air interface, this may be accomplished by successively energising the motors to drive the winch until the load is balanced at the chosen mean pressure for the system. It is also necessary to change from seismic behaviour of the load to a wave compensating mode (to prevent the object being raised remaining or tending to remain stationary in space and to obviate the possibility of a ship mounted boom or 'A' frame over which the rope passes striking the object due to wave induced motion of the ship). To accomplish this change, the control valve 23 is closed, diverting fluid from the pump unit 24 through the non-return valve 29 and hence effectively isolating all winch motors other than motor 1 from the hydraulic accumulator 26. The displacement of motor 1 may be reduced to ensure that in the case of a load within the capability of a single motor, that this motor alone is unable to lift the object from the water. It is thus ensured that whereas the object may be raised by a wave before it rises clear of the sea surface, it cannot fall back as the wave recedes. It is also impossible for it to behave in an oscillatory manner.

As a further refinement, the displacement of one or more of the variable displacement motors may optionally be automatically controlled by the mean pressure in the supply line, the signal being taken from the connection to gauge 38. This is of assistance in providing enhanced break-out tension in the rope, automatically reducing to the required lift tension after break-out is attained.

Whilst the winch mechanisms described above with reference to FIGS. 4 to 6 each have three motors 1, 2 and 3 of which two are of variable displacement and the third is of fixed displacement, only one variable displacement motor will serve as described with reference to FIG. 3; and alternatively more than two variable displacement motors, and/or one or more further fixed displacement motor(s) can be provided where an increased capacity is required.

Preferably, but not necessarily, the number of motors provided is made up by complementary pairs of one variable and one fixed displacement motor.

Although it is not shown in the drawings, more than one of the accumulators 25 and 26 may be provided to permit the compensating mechanism to be tuned to the prevailing conditions by altering the number of accumulators in use. For example, in a rough sea six high-pressure and three low-pressure accumulators could be used, whereas in calmer seas these numbers could be reduced to four high-pressure and two low-pressure accumulators, or even two high-pressure accumulators and one low-pressure accumulator.

Storage of some cables is more satisfactory in a locker rather than on a drum. With locker storage, the motor 16 is omitted because the vertical fall of the cable between the hauling pulleys and the locker provides adequate tension to prevent slipping of the cable.

The winch mechanisms described above can also be used for towing at sea, or mooring.

I claim:

1. A winch mechanism comprising:

a rope haulage mechanism;

a variable displacement hydraulic pump/motor;

coupling means coupling said pump/motor to said rope haulage mechanism for driving said rope haulage mechanism;

a circulating pump;

first hydraulic fluid supply line means for conveying hydraulic fluid between said circulating pump and said pump/motor, said first hydraulic fluid supply line means including an hydraulic fluid accumulator; and second hydraulic fluid supply line means for conveying hydraulic fluid between said circulating pump and said pump/motor, said second hydraulic fluid supply line means including an hydraulic fluid reservoir.

2. A winch mechanism as claimed in claim 1, including:

at least one further pair of hydraulic pump/motors, the or each pair comprising one fixed displacement pump/motor and one variable displacement pump/motor; and connecting means for drivingly interconnecting all of the pump/motors.

3. A winch mechanism as claimed in claim 1 and including means for selectively energising the hydraulic pump/motors whereby the load to be handled may be balanced.

4. A winch mechanism as claimed in claim 1, including means for pressurising said reservoirs so as to form a further hydraulic fluid accumulator in said second supply line means.

5. A winch mechanism as claimed in claim 4, including a plurality of accumulators in each of said first and second supply lines means, and means for selectively connecting said accumulators for tuning said mechanism to prevailing conditions.

6. A winch mechanism as claimed in claim 1, wherein the rope haulage mechanism comprises a pulley, a storage drum driven by a further hydraulic motor, and a rope extending about the pulley and to the storage drum.

7. A winch mechanism as claimed in claim 1, wherein the rope haulage mechanism comprises a winch drum.

8. A winch mechanism as claimed in claim 1, wherein the rope haulage mechanism comprises a pulley and a rope extending about the pulley and to a locker disposed at a level below the pulley.

9. A winch mechanism as claimed in claim 2, wherein the rope haulage mechanism comprises two or more pulleys connected by said coupling means to at least two of the hydraulic pump/motors, a storage drum driven by a further hydraulic motor, and a rope extending about the pulleys and to the storage drum.

10. A winch mechanism as claimed in claim 2, wherein the rope haulage mechanism comprises a winch drum.

11. A winch mechanism as claimed in claim 2, wherein the rope haulage mechanism comprise two or mre pulleys drivingly connected by said coupling means to at least two of the hydraulic pump/motors, and a rope extending about the pulleys and to a locker disposed at a level below the pulleys.

12. A winch mechanism as claimed in claim 1, including a selectively engageable non-return valve between said hydraulic pump/motor and said accumulator in said first supply line means.

13. A winch mechanism as claimed in claim 2, including a selectively engageable non-return valve between at least one of said hydraulic pump/motors and said accumulator in said first supply line means.

* * * * *